US007485614B2

(12) United States Patent
Boucher et al.

(10) Patent No.: US 7,485,614 B2
(45) Date of Patent: Feb. 3, 2009

(54) PROCESS FOR FORMING A LOW DENSITY DETERGENT GRANULE

(75) Inventors: Jeffrey Edward Boucher, Loveland, OH (US); Rui Shen, Newcastle Upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 462 days.

(21) Appl. No.: 11/233,327

(22) Filed: Sep. 22, 2005

(65) Prior Publication Data

US 2006/0069007 A1 Mar. 30, 2006

Related U.S. Application Data

(60) Provisional application No. 60/612,659, filed on Sep. 24, 2004.

(51) Int. Cl.
*C11D 11/02* (2006.01)

(52) U.S. Cl. ..... 510/443; 510/452

(58) Field of Classification Search ..... 510/443, 510/452

See application file for complete search history.

(56) References Cited

U.S. PATENT DOCUMENTS 3,915,903 A 10/1975 Wise
3,962,149 A * 6/1976 Chirash et al. ..... 510/283
4,006,110 A * 2/1977 Kenney et al. ..... 510/349
4,166,039 A * 8/1979 Wise ..... 510/453
4,552,681 A * 11/1985 Koch et al. ..... 510/356
5,977,053 A * 11/1999 Groth et al. ..... 510/480
5,998,356 A * 12/1999 Alam et al. ..... 510/443
2003/0203832 A1 * 10/2003 Boucher et al. ..... 510/443

FOREIGN PATENT DOCUMENTS

GB 1 514 264 6/1978

OTHER PUBLICATIONS

International Search Report, PCT/US2005/033910, 2 pages.

* cited by examiner

*Primary Examiner*—Lorna M Douyon
(74) *Attorney, Agent, or Firm*—Ronald T. Sia; David V. Upite; Kim W. Zerby

(57) ABSTRACT

A process for forming a low density detergent granule has the steps of providing from about 0.1% to about 6% of a hydrotrope, providing from about 22% to about 50% crutcher mix moisture, providing from about 0.2% to about 8% of a water-soluble polymer with a molecular weight of at least about 10,000 g/mol, providing from about 2% to about 20% sodium silicate having a $SiO_2$:$Na_2O$ ratio of at least about 2:1, and the balance of adjunct crutcher ingredients, mixing the hydrotrope, crutcher mix moisture, polymer, silicate, and adjunct crutcher ingredients in a crutcher to form a slurry, injecting a gas into the slurry at a pressure of from about 6,000 kPa to about 13,000 kPa, and at a rate of from about 0.01% to about 0.25% and forming the slurry into a detergent granule. The slurry is substantially free of zeolite builder and phosphate builder and the crutcher temperature is maintained at from about 40° C. to about 95° C.

17 Claims, No Drawings

PROCESS FOR FORMING A LOW DENSITY DETERGENT GRANULE

CROSS REFERENCE TO RELATED APPLICATION

This application claims the benefit of U.S. Provisional Application No. 60/612,659, filed on Sep. 24, 2004.

FIELD OF THE INVENTION

The present invention relates to process for forming a detergent granule. Specifically, the present invention relates to processes for forming a low density detergent granule.

BACKGROUND OF THE INVENTION

Processes for forming detergent granules are well known in the art and have typically involved the steps of forming a detergent slurry by mixing a builder, a neutralized or acid-form anionic surfactant, a filler, water/free moisture, processing aids, deaerants, brighteners and/or organic polymers in a crutcher, pumping the detergent slurry to the top of a spray drying tower, and spraying the detergent slurry from nozzles in the tower to form atomized droplets. Hot air is pumped into the bottom of the spray drying towers such that when the atomized droplets are sprayed into the hot air, they immediately dry into a powder as the free moisture evaporates. The spray-dried granules thus formed are then collected at the bottom of the tower. Alternatively, agglomeration process are also well known.

While the spray drying conditions within the spray drying tower contain many critical variables such as temperature, air flow rate, humidity, etc., the conventional spray drying wisdom leads one to believe that adding high levels of anionic and cationic surfactants, especially anionic surfactants to the slurry prior to pumping and spray drying is highly desirable in order to result in a proper slurry. Without such a proper slurry, having the right phase, viscosity and pumping characteristics, the resulting particles will be too light, too dense, too wet, the wrong size, and/or sticky, leading to over hydration and thickening of the slurry, lumps and/or possess other undesirable physical characteristics. Thus, the detergent slurries employed in typical spray drying processes contain from about 15% to about 25% organic materials, which correspond to from 20% to 40% organic materials in the final spray-dried granule. These organic materials are typically anionic and cationic surfactants, polymers, etc. However, it has been found that high levels of surfactants in the spray dried granule can limit the amount and type of other additives added, and can also limit the feasibility of additional processing. For example, adding even up to 3% nonionic surfactant to spray dried granules containing these levels of organic materials often results in sticky granules which have poor flow properties, and excessive caking. Also, spray dried granules containing anionic surfactants may not have a sufficient porosity to absorb large amounts of other additives during subsequent processing. In addition, spray dried granules containing anionic surfactants may reduce formulation alternatives, as builders such as phosphate and zeolites are required because of their strong binding abilities to hard metal ions. Furthermore, such builders have certain environmental and cost limitations. Thus, while spray drying processes are known, and have been for many years, it has now been recognized that they are relatively inflexible and possess significant processing constraints. In addition, certain process are only adequate for forming a high density and/or a compact detergent granule, whereas certain markets and consumers prefer low density granules.

While some detergent granule processes and detergent granules are known, it has been found that such detergent granules typically possess limitations in, for example, production rates, density, and/or solubility, caking etc.

Accordingly, the need exists for a more process for forming a low density, i.e., from about 300 g/L to about 600 g/L, detergent granule which overcomes the above limitations and problems, while reducing the need for significant capital investment.

SUMMARY OF THE INVENTION

The present invention relates to a process for forming a low density detergent granule having the steps of providing from about 0.1% to about 6% of a hydrotrope, providing from about 22% to about 50% crutcher mix moisture, providing from about 0.2% to about 8% of a water-soluble polymer with a molecular weight of at least about 10,000 g/mol, providing from about 2% to about 20% sodium silicate having a $SiO_2$:$Na_2O$ ratio of at least about 2:1, and the balance of adjunct crutcher ingredients, mixing the hydrotrope, crutcher mix moisture, polymer, silicate, and adjunct crutcher ingredients in a crutcher to form a slurry, injecting a gas into the slurry at a pressure of from about 6,000 kPa to about 13,000 kPa, and at a rate of from about 0.01% to about 0.25% and forming the slurry into a detergent granule. The slurry is substantially free of zeolite builder and phosphate builder and the crutcher temperature is maintained at from about 40° C to about 95° C.

It has now been surprisingly found that the combination of specific ingredients and a controlled process can form a detergent granule having both a low organic level while maintaining one or more physical properties such as low cake strength, high granule strength, constant granule quality, high flowability, high solubility, high absorption of adjunct and/or spray-on ingredients, low density. Furthermore, the present invention reduces undesirable crystallization and separation in the crutcher. The invention herein may also provide high production rates, leading to more efficient use of capital equipment.

DETAILED DESCRIPTION OF THE INVENTION

All percentages, ratios and proportions herein are by weight of the detergent slurry, unless otherwise specified. All temperatures herein are in degrees Celsius (° C.) unless otherwise indicated.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, the term "comprising" means that other steps, ingredients, elements, etc. which do not adversely affect the end result can be added. This term encompasses the terms "consisting of" and "consisting essentially of".

As used herein, the term "detergent granule" indicates a granule which is used in a detergent composition, and thus includes within the scope of the term: a granule which is the complete detergent composition, a granule which is to be used as an additive in a detergent composition, a "base granule" for a detergent composition, etc.

The present invention relates to a process for forming a detergent granule by providing a hydrotrope, a polymer, crutcher mix moisture, less than about 20% sodium silicate, and the balance adjunct crutcher ingredients and mixing them in a crutcher to form a slurry. Gas is injected into the slurry, preferably in the pipeline after the crutcher and high pressure pump, and the slurry is formed into detergent granules. The slurry should be substantially free of zeolite builder and phosphate builder, and the crutcher temperature should be from about 40° C. to about 95° C. Such a process provides a detergent granule which has many surprising benefits, such as increased absorbency, improved physical properties such as strength, low density, and/or a high throughput.

Hydrotrope

The hydrotrope useful herein is typically present from about 0.1% to about 6%, preferably from about 0.2% to about 4%, more preferably from about 0.3% to about 2%, by the weight of the slurry. Without intending to be limited by theory, it is believed that the hydrotrope binds together the hydrophobic and hydrophilic portions of the slurry to improve processability and prevent separation. In addition, for low organic formulations, the addition of a hydrotrope may significantly help to improve the structuring of the slurry, reduce the density of the detergent granule. The hydrotrope typically has at least one sulphonate group such as found in an alkyl aryl sulphonate or an alkyl aryl sulfonic acid. In an embodiment herein, the alkyl aryl sulphonate includes: sodium, potassium, calcium and ammonium xylene sulphonates; sodium, potassium, calcium and ammonium toluene sulphonates; sodium, potassium, calcium and ammonium cumene sulphonates; sodium, potassium, calcium and ammonium substituted or unsubstituted naphthalene sulphonates; and a mixture thereof. In an embodiment herein, the alkyl aryl sulfonic acid includes: xylene sulfonic acid, toluene sulfonic acid, cumene sulfonic acid, substituted or unsubstituted naphthalene sulfonic acid and a mixture thereof. In an embodiment herein, the hydrotrope is selected from the sodium and potassium salts of cumene sulphonate and toluene sulphonate and a mixture thereof. The salts of p-toluene sulfonate may also be used herein. Contrary to previous thought, the present invention has found that by adding a hydrotrope, the slurry can be thickened so as to improve structuring and increase the retention of gas in the slurry. However, the amount of hydrotrope needs to be cost-effective in the formulation. Such hydrotropes are readily available as commodity items from multiple sources around the world.

In an embodiment herein, the hydrotrope has multiple sulphonate groups, such as found in the DOWFAX™ series of hydrotropes available from The Dow Chemical Company, Midland Mich., USA. In an embodiment of the invention, the hydrotrope has two sulphonate groups on a diphenyl oxide backbone, while the hydrophobic portion may be a linear or branched alkyl group of from six to sixteen carbon atoms.

Crutcher Mix Moisture

The crutcher mix moisture in the slurry should be from about 22% to about 50% by weight of the slurry. In another embodiment, the crutcher mix moisture is from about 24% to about 38%. In another embodiment, the crutcher mix moisture is from about 26% to about 34%. Crutcher mix moisture includes both free water and releasable water bound to another molecule, for example, as a hydrate. Crutcher mix moisture may come from the various slurry ingredients themselves, such as a hydrotrope solution, or may be specifically, separately added as free water, as desired. Without intending to be limited by theory, it is believed that the crutcher mix moisture level is crucial to ensure proper mixing and homogenization of the slurry. Controlling the combination of hydrotrope and crutcher mix moisture is essential to prevent separation of the slurry ingredients and/or unwanted crystallization in the crutcher. While high levels of crutcher mix moisture decrease viscosity and increase hydration, over hydration can occur, leading to thickening and even solidification of the slurry. Higher levels of crutcher mix moisture are undesirable as such a slurry requires extra energy to dry the slurry to the desired detergent granule moisture level. Lower levels of crutcher mix moisture, in contrast, can save the energy, but lead to an increased viscosity which may create a large burden on the mixer, pumps, and/or other equipment leading to increased equipment failure. In addition, lower levels of crutcher mix moisture may lead to incomplete or insufficient homogenization and/or poor slurry atomization, which could lead to poor granule drying and poor/inconsistent physical properties in the detergent granule.

Polymer

The slurry typically contains from about 0.2% to about 8% of a water-soluble polymer. In another embodiment, the water-soluble polymer is from about 0.3% to about 6%. In another embodiment, the water-soluble polymer is from about 0.4% to about 4%. The water-soluble polymer is used as a structure aid to support the granule and to avoid caking/break up during later process steps, and/or during transportation of the finished detergent product. The water-soluble polymer may be a copolymer, if desired. The water-soluble polymer herein has a molecular weight of at least about 10,000 g/mol. In an embodiment herein, the water-soluble polymer has a molecular weight of from about 10,000 g/mol to about 1,000,000 g/mol. In another embodiment herein, the water-soluble polymer has a molecular weight of from about 12,000 g/mol to about 100,000 g/mol. The water-soluble polymer is in a salt or an acid form and typically contains multiple ionic moieties, such as carbonate moieties, to help solubilize the polymer backbone. The water-soluble polymer typically has a straight-backboned polymers, but branched-backbone polymers may also be useful herein. In an embodiment herein the water-soluble polymer is a copolymer having monomers selected from acrylic acid, malic acid and/or maleic acid. Typically, the water-soluble polymer is a sodium salt and/or a potassium salt. Such a water-soluble polymer is available from, for example, Shenyang Xinqi Daily Chemical Co. Ltd, Shenyang, China; BASF Aktiengesellschaft, Ludwigshafen, Germany. In an embodiment of the invention, the polymer is a copolymer of acrylic acid and maleic acid, as it has been found that such a polymer surprisingly improves the overall color and whiteness of the detergent granule.

Sodium Silicate

Sodium silicate is present in the slurry, but sodium silicates with higher $SiO_2$:$Na_2O$ ratios are preferred, whereas sodium silicates having a low $SiO_2$:$Na_2O$ are to be minimized and/or avoided. Thus, the sodium silicate useful herein has a $SiO_2$:$Na_2O$ ratio of at least about 2:1. In an embodiment herein, the sodium silicate herein has a $SiO_2$:$Na_2O$ ratio of from about 2:1 to about 5:1. In another embodiment herein, the sodium silicate herein has a $SiO_2$:$Na_2O$ ratio of from about 2.1:1 to about 3.5:1. It has surprisingly been found that sodium silicate having a low $SiO_2$:$Na_2O$ ratio provides poor structuring of the slurry and may lead to an undesirable level of product caking. In addition, even though the solubility may be better with lower ratio sodium silicates, they also yield a detergent granule having an undesirable color. The slurry contains from about 2% to about 20% sodium silicate having the above $SiO_2$:$Na_2O$ ratio. In an embodiment of the present invention, the slurry contains from about 4% sodium silicate to about 16% sodium silicate. In another embodiment of the present invention, the slurry contains from about 6% sodium silicate to about 12% sodium silicate.

The sodium silicate herein is a commodity raw material which is freely available from multiple suppliers around the world.

Adjunct Crutcher Ingredients

The balance of the slurry is made of up adjunct crutcher ingredients such as fillers, sodium sulfate, etc. It is preferred that the total amount of organic material in the slurry be less than about 40% so as to keep the viscosity low, to enhance drying, and to reduce caking. In an embodiment herein, the total amount of organic material in the slurry is from about 0% to about 40%. In an embodiment herein, the total amount of organic material in the slurry is from about 5% to about 35%. In another embodiment herein, the total amount of organic material in the slurry is from about 8% to about 30%. The organic material herein is a complex carbon and hydrogen molecule-containing material (i.e., a hydrocarbon) which is typically derived directly or indirectly from a living organism. Typical organic materials include surfactants, polymers, organic solvents, optical brighteners, organic chelants, fatty acids, organic pigments/dyes, and carboxylic acids. In contrast, the inorganic material herein is any material which does not contain complex carbon and hydrogen molecules, and typically includes inorganic salts, inorganic fillers, inorganic builders, amides, inorganic pigments/dyes, and especially the sodium, potassium, magnesium, and calcium salts of these inorganic materials, all of which are well known in the art.

Contrary to the typical practice in the detergent granule processing art, the slurry in the present invention is substantially free of zeolite builders and phosphate builders, as it has been found that such builders are not needed to provide acceptable cleaning. In an embodiment herein, the slurry contains less than from about 0.1% zeolite and phosphate builder. A slurry which is thus substantially free of zeolite reduces or eliminates the chance that the sodium silicate will react with the zeolite. In addition, this reduces the amount of phosphate which reverts during processing/drying, and thereby reduces or eliminates the incidence of insoluble phosphate byproducts.

Sodium sulfate is an especially preferred adjunct crutcher ingredient due to its high solubility.

Temperature

The crutcher (slurry) temperature is maintained at from about 40° C. to about 95° C., or from about 50° C. to about 80° C., or from about 60° C. to about 70° C., to provide sufficient drying of the detergent granule. If the temperature is lower, then the slurry may suffer from an undesirably high viscosity, poor homogenization, poor atomization, etc. If the temperature is in the range described, then lower viscosity and good atomization is expected. However, too high of a temperature will lead to a high density product. This temperature can be maintained by, for example, by employing an electrical heater, a cooling or heating water jacket, steam heat, etc. as is needed.

Gas Injection

During the mixing process, a gas is injected into the slurry at a pressure of from about 6,000 kPa to about 13,000 kPa. In an embodiment herein, the gas is injected into the slurry at a pressure from about 7,000 kPa to about 12,000 kPa. In an embodiment herein, the gas is injected into the slurry at a pressure from about 8,000 kPa to about 11,000 kPa. The gas is injected at a rate of about 0.01% to about 0.25% by weight of the slurry. In an embodiment herein, the gas is injected into the slurry at a rate of from about 0.015% to about 0.15%, by weight of the slurry. In an embodiment herein, the gas is injected into the slurry at a rate of from about 0.02 to about 0.11%, by weight of the slurry. In an embodiment of the present invention, the gas contains nitrogen gas. In an embodiment of the present invention, the gas is air, such as pressurized air pumped from the ambient atmosphere. Without intending to be limited by theory, it is believed that such injected gas helps to puff up the slurry and thereby reduce the overall density of the detergent granule.

The gas is typically injected into the slurry during the transfer of the slurry between the crutcher and the further processing steps, such as the spray drying tower.

Forming the Slurry into a Detergent Granule

After mixing in the crutcher, the slurry is usually moved to a drop tank from where it is pumped via a low pressure pump, through a disintegrator to a high pressure pump, and from there to the nozzle(s) which spray the slurry into the spray drying tower for drying. In an embodiment herein, the gas is injected into the slurry in the pipe after the crutcher and after the high pressure pump which pumps the slurry to the spray drying tower. Both batch and continuous processes are useful herein, and the slurry may be maintained at the above temperatures via, for example, heating the pipes through which it is pumped. During the crutching and/or pumping processes, the slurry density is typically from about 0.8 g/mL to about 1.2 g/mL. In some cases, air may have to be removed (i.e., deaeration), via, either mechanical or chemical means, to achieve the desired slurry density.

Spray Drying Tower

The spray drying tower useful herein is well-known in the art, and may have a single nozzle or preferably a plurality of nozzles, and more preferably from about 2 to about 10 nozzles, through which the slurry is sprayed, to atomize the slurry. Furthermore, the spray drying tower may contain nozzles at a single level within the spray drying tower, or at multiple levels within the spray drying tower. The nozzle may itself be heated or cooled, as desired, and may be a pressure or air atomization nozzle. If a pressure nozzle is employed, then a high pressure pump is typically provided immediately prior to the nozzle(s) so as to properly atomize the slurry. Furthermore, pressure nozzles may contain different sized nozzle inserts and/or different nozzle tip openings known in the art; preferably the nozzle chamber No. 4, 5, 6, 7, 8, 10, 15, or 20, preferably nozzle chamber No. 8 (inlet orifice size 4.09 mm), 10 (inlet orifice size 4.37 mm), 15 (inlet orifice size 4.04 mm×2), or 20 (inlet orifice size 4.67 mm×2), while the nozzle tip opening is from about 2 mm to abut 4 mm, or from about 2.5 mm to about 3.8 mm, or from about 2.7 mm to about 3.5 mm. Alternatively, a spinning disk may be used in place of at least one nozzle, and the atomization controlled by varying the spinning speed of the disk. A spinning disk is especially useful in concurrent spray drying towers.

The spraying pressure through the nozzle is highly variable and depends upon many factors such as the desired physical properties of the detergent granule, the viscosity and phase characteristics of the slurry, and the equipment available. Generally, the slurry will be sprayed from the nozzle(s) at a pressure of greater than about 1,000 kPa, or from about 1,000 kPa to about 9,000 kPa, or from about 1,500 kPa to about 8,000 kPa.

Hot air is provided in the spray drying tower, in either a concurrent or counter current direction, to dry the atomized slurry to form a detergent granule. The hot air is provided by a furnace (e.g., natural gas or fuel oil) and introduced by vents into the spray tower at from about 150° C. to about 600° C., or from about 200° C. to about 400° C., or from about 240° C. to about 340° C. The furnace inlet vents are typically angled to provide a helical air flow within the spray drying tower. Such a helical air flow may also be produced or modified by the use of baffles within the spray tower itself. Without intending to be limited by theory, it is believed that a helical air flow is especially desirable as it increases turbulence within the spray tower, thereby resulting in improved heat transfer and drying. However, a spray drying tower having a straight-through air flow design is also useful herein.

The detergent granules formed typically have an average particle size of from about 100 microns to about 600 microns, or from about 150 microns to about 500 microns, or from about 200 microns to about 450 microns in diameter. Furthermore, the average bulk density of the detergent granules produced is preferably from about 200 g/L to about 600 g/L, or from about 250 g/L to about 575 g/L, or from about 300 g/L to about 550 g/L, which may be lower than the density of the finished detergent product. In an embodiment herein, oversize and undersize particles are separated (e.g., by employing sifting and/or filtering apparatus/steps) and recycled by adding them into the crutcher to form the slurry.

Processing to Form a Detergent Composition

Once the detergent granule is formed, additional processing may be required to transform it into a complete detergent composition. Typically, such additional processing steps include spraying additional adjunct ingredients onto the granule in a mixing drum, agglomerating the detergent granule to increase its size/density, passing the detergent granule through a fluid bed or other type of dryer, mixing in additional detergent components and/or dusting the detergent granule, and other steps known in the art. Forberg mixers, fluid bed dryers, and Löbdige mixers may also be used herein. During such additional processing steps, additives such as dyes, pigments, perfumes, enzymes, polymers, bleaches, surfactants, silicates, etc. may be added.

Another process step which can be used to further densify the detergent granule involves treating the detergent granules in a moderate speed mixer/densifier. such as that marketed under the tradename "LÖDIGE KM™" (Series 300 or 600) or "LÖDIGE PLOUGHSHARE™" mixer/densifiers and/or the "DRAIS K-T 160™". "SCHUG™" and "TURBULIZER™" mixers from BEPEX Corporation are also useful. Such equipment is typically operated at 40-160 rpm. The residence time of the detergent ingredients in the moderate speed mixer/densifier is from about 0.1 to about 12 minutes conveniently measured by dividing the steady state mixer/densifier weight by the throughput (e.g., kg/hr). This process step which employs a moderate speed mixer/densifier (e.g. Lödige KM) can be used by itself or sequentially with a high speed mixer/densifier (e.g. Lödige CB) to achieve the desired density. Other types of granules manufacturing apparatus useful herein include the apparatus disclosed in U.S. Pat. No. 2,306,898, to Heller, issued on Dec. 29, 1942.

While it may be more suitable to use the high speed mixer/densifier followed by the low speed mixer/densifier, the reverse sequential mixer/densifier configuration also can be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel, et al., U.S. Pat. No. 5,133,924, issued Jul. 28, 1992; Delwel, et al., U.S. Pat. No. 4,637,891, issued Jan. 20, 1987; Kruse, et al., U.S. Pat. No. 4,726,908, issued Feb. 23, 1988; and Bortolotti, et al., U.S. Pat. No. 5,160,657, issued Nov. 3, 1992.

Optionally, in certain cases, the low density detergent granule herein will be further processed to form a high density detergent composition. Such high density detergent compositions may be produced by blending conventional or densified detergent granules with detergent agglomerates in various proportions (e.g. a 60:40 weight ratio of granules to agglomerates) produced by one or a combination of the processes discussed herein. See U.S. Pat. No. 5,569,645 to Dinniwell, et al., issued Oct. 29, 1996. Additional adjunct ingredients such as enzymes, perfumes, brighteners and the like can be sprayed or admixed with the agglomerates, granules or mixtures thereof produced by the processes discussed herein.

In an embodiment of the invention, the detergent granule is sprayed with a nonionic surfactant, an amphoteric surfactant, an amine oxide, an anionic surfactant, a polymer, a perfume, and/or a silicate in a drum mixer or a fluid bed, to produce a detergent composition. In an embodiment here, the detergent granule is sprayed with a nonionic surfactant and/or a perfume. If present, the level of nonionic surfactant which may be sprayed onto the detergent granule is from about 0.05% to about 50%, or from about 0.1% to about 40%, or from about 0.5% to about 25%, or from about 3% to about 20% by weight of the detergent granule. Such a granule has good flowability, improved dissolution, low cake strength, high water hardness tolerance, good cleaning performance, and/or high product stability.

Nonionic surfactants useful herein are generally disclosed in U.S. Pat. No. 3,929,678 to Laughlin, et al., issued Dec. 30, 1975, at column 13, line 14 through column 16, line 6. Other nonionic surfactants useful herein include the condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include TERGITOL® 15-S-9 (the condensation product of $C_{11}$-$C_{15}$ linear secondary alcohol with 9 moles ethylene oxide), TERGITOL® 24-L-6 NMW (the condensation product of $C_{12}$-$C_{14}$ primary alcohol with 6 moles ethylene oxide with a narrow molecular weight distribution), both marketed by Union Carbide Corporation; NEODOL® 45-9 (the condensation product of $C_{14}$-$C_{15}$ linear alcohol with 9 moles of ethylene oxide), NEODOL® 23-6.5 (the condensation product of $C_{12}$-$C_{13}$ linear alcohol with 6.5 moles of ethylene oxide), NEODOL® 45-7 (the condensation product of $C_{14}$-$C_{15}$ linear alcohol with 7 moles of ethylene oxide), NEODOL® 45-4 (the condensation product of $C_{14}$-$C_{15}$ linear alcohol with 4 moles of ethylene oxide), marketed by Shell Chemical Company, and KYRO® EOB (the condensation product of $C_{13}$-$C_{15}$ alcohol with 9 moles ethylene oxide), marketed by The Procter & Gamble Company, Cincinnati, Ohio, U.S.A. Other commercially available nonionic surfactants include DOBANOL 91-8® marketed by Shell Chemical Co. and GENAPOL UD-080® marketed by Hoechst. This category of nonionic surfactant is referred to generally as "alkyl ethoxylates." Also useful herein is a nonionic surfactant selected from the group consisting of an alkyl polyglycoside surfactant, a fatty acid amide surfactant, a $C_8$-$C_{20}$ ammonia amide, a monoethanolamide, a diethanolamide, an isopropanolamide, and a mixture thereof. Such nonionic surfactants are known in the art, and are commercially-available.

The amphoteric surfactant herein is preferably selected from the various amine oxide surfactants. Amine oxides are semi-polar nonionic surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred amine oxide surfactants have the formula:

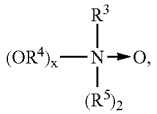

where $R^3$ is an alkyl, a hydroxyalkyl, an alkyl phenyl group or a mixture thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or a hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure. Preferred amine oxide surfactants include the $C_{10}$-$C_{18}$ alkyl dimethyl amine oxides and the $C_8$-$C_{12}$ alkoxy ethyl dihydroxy ethyl amine oxides.

Also suitable are amine oxides such as propyl amine oxides, represented by the formula:

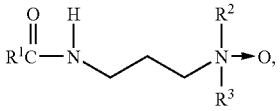

where $R^1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R^2$ and $R^3$ are each methyl, ethyl, propyl, isopropyl, 2-hydroxyethyl, 2-hydroxypropyl, or 3-hydroxypropyl and n is from 0 to about 10.

A further suitable species of amine oxide semi-polar surface active agents comprise compounds and mixtures of compounds having the formula:

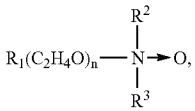

where $R^1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10. Particularly preferred are amine oxides of the formula:

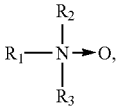

where $R_1$ is a $C_{10-14}$ alkyl and $R_2$ and $R_3$ are methyl or ethyl. Because they are low-foaming it may also be particularly desirable to use long chain amine oxide surfactants which are more fully described in U.S. Pat. No. 4,316,824 to Pancheri, granted on Feb. 23, 1982; U.S. Pat. No. 5,075,501 to Borland and Smith, granted on Dec. 24, 1991; and U.S. Pat. No. 5,071,594 to Borland and Smith, granted on Dec. 10, 1991.

Other suitable, non-limiting examples of the amphoteric surfactant useful in the present invention includes amido propyl betaines and derivatives of aliphatic or heterocyclic secondary and ternary amines in which the aliphatic moiety can be straight chain, or branched and wherein one of the aliphatic substituents contains from about 8 to about 24 carbon atoms and at least one aliphatic substituent contains an anionic water-solubilizing group.

Further examples of suitable amphoteric surfactants are disclosed in "Surface Active Agents and Detergents" (Vol. I and II by Schwartz, Perry and Berch).

Anionic surfactants useful herein include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3) alkyl sulfates of the formula $CH_3(CH_2)_x(CHOSO_3^-M^+)\,CH_3$ and $CH_3\,(CH_2)_y(CHOSO_3^-M^+)\,CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates ("$AE_xS$"; especially EO 1-7 ethoxy sulfates), sulfated polyglycosides, and $C_{12}$-$C_{18}$ alpha-sulfonated fatty acid esters, all of which are known in the art. Such surfactants are typically present at levels of at least about 1%, or from about 1% to about 55%.

Typical polymers useful herein include polymeric soil release agents, polymeric dispersing agents, clay soil removal/anti-redeposition agents, dye transfer inhibition agents, suds suppressers, and suds enhancers. Exemplary ethoxylated amines are described in U.S. Pat. No. 4,597,898 to VanderMeer, issued Jul. 1, 1986. Another group of preferred clay soil removal/anti-redeposition agents are the cationic compounds disclosed in European Patent Application 111 965 to Oh and Gosselink, published Jun. 27, 1984. Other useful clay soil removal/antiredeposition agents include the ethoxylated amine polymers disclosed in European Patent Application 111 984 to Gosselink, published Jun. 27, 1984; the zwitterionic polymers disclosed in European Patent Application 112 592 to Gosselink, published Jul. 4, 1984; and the amine oxides disclosed in U.S. Pat. No. 4,548,744 to Connor, issued Oct. 22, 1985. Other clay soil removal and/or anti redeposition agents known in the art can also be utilized in the compositions herein. Another type of preferred antiredeposition agent includes the carboxy methyl cellulose materials. These materials are well known in the art. Generally, dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, or from about 0.01% to about 5%, or from about 0.05% to about 2%. See, for example, EP-A-262,897 to Hull and Scowen, published Apr. 6, 1988 and EP-B-256,696 to Hull, issued Dec. 13, 1989.

Enzymes may also be useful herein, and are typically added as enzyme prills during a dry admix stage. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated another way, the compositions herein will typically comprise from 0.001% to 5%, preferably 0.01%-1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniformis*. One suitable protease is obtained from a strain of *Bacillus*, having maximum activity throughout the pH range of 8-12, developed and sold as ESPERASE® by Novo Industries A/S of Denmark, hereinafter "Novo". Other suitable proteases include ALCALASE® and SAVINASE® from Novo and MAXATASE® from International Bio-Synthetics, Inc., The Netherlands; see also the proteases disclosed in EP 130,756 A to Bott, published Jan. 9, 1985; EP 303,761 B, to Post, et al., issued Sept. 9, 1992; WO 9318140 A1 to Aaslyng et al., published Sep. 16, 1993; WO 9510591 A1 to Baeck et al., published Apr. 20, 1995; WO 9507791 A1 to Gerber, published Mar. 23, 1995; and WO 9425583 to Branner, et al., published Nov. 10, 1994.

Amylases suitable herein include, for example, α-amylases described in GB 1,296,839 to Outtrup, et al., published Nov. 22, 1972 to Novo; RAPIDASE®, International Bio-Synthetics, Inc.; TERMAMYL® from Novo; FUNGAMYL® from Novo; DURAMYL®, from Novo; the amylases described in: WO 9402597 to Bisgard-Frantzen and Svendsen, published Feb. 3, 1994; WO 9418314 to Antrim, et al., to Genencor International, published Aug. 18, 1994; WO 9402597 to Bisgard-Frantzen and Svendsen, published Feb. 3, 1994; and WO 9509909 A to Borch, et al., published Apr. 13, 1995.

Cellulases useful herein are disclosed in GB-B-2.075.028 to Barbesgaar, et al., issued Mar. 28, 1984; GB-B-2.095.275 to Murata, et al., issued Aug. 7, 1985 date as 095275 and DE-OS-2.247.832 to Horikoshi and Ikeda, issued Jun. 27 1974. CAREZYME® and CELLUZYME® (Novo) are especially useful. See also WO 9117243 to Hagen, et al., published Nov. 14, 1991 as to Novo.

Lipases useful herein include those disclosed in GB 1,372,034 to Dijk and Berg, published Oct. 30, 1974; Japanese Patent Application 53,20487 to Inugai, published Feb. 24, 1978 (available from Amano Pharmaceutical Co. Ltd., Nagoya, Japan, under the trade name Lipase P "Amano" or "Amano-P"); LIPOLASE® commercially available from Novo; EP 341,947 to Comelissen, et al., issued Aug. 31, 1994; WO 9414951 to Halkier, et al., published Jul. 7, 1994 A to Novo; and WO 9205249 to Clausen, et al., published Apr. 2, 1992.

Peroxidase enzymes and enzyme stabilizing systems may also be useful herein.

The detergent compositions herein may optionally comprise other known detergent cleaning components at levels of from about 0.01% to about 10%, including alkoxylated polycarboxylates, bleaching compounds, brighteners, chelating agents, dye transfer inhibiting agents, enzyme stabilizing systems, and/or fabric softeners. Such components are typically added to the detergent granule in an admix, or as spray-on components, as is appropriate.

Additional optional spray drying apparatuses and processes are described in, for example, U.S. Pat. No. 5,496,487 to Capeci, et al., issued on Mar. 5, 1996; U.S. Pat. No. 4,963,226 to Chamberlain, issued on Oct. 16, 1990; and U.S. Pat. No. 4,129,511 to Ogoshi, et al., issued on Dec. 12, 1978.

Cake strength can be measured by methods known in the art, such as described in U.S. Pat. No. 4,290,903 to Macgilp and Mann, issued on Sep. 22, 1981 at col. 6, lines 29-42. Flowability is tested via a Hosokawa Powder Characteristics Tester type PT-E.

Examples of the invention are set forth hereinafter by way of illustration and are not intended to be in any way limiting of the invention. The examples are not to be construed as limitations of the present invention since many variations thereof are possible without departing from its spirit and scope.

EXAMPLE 1

Anionic surfactant, sodium sulfate, 13% sodium silicate 2.4r, 4% sodium salt copolymer of acrylate and maleate (MW about 10,000), 3% sodium toluene sulphonate, other polymeric material, and optical brightener are mixed in a crutcher at about 60~70° C. until evenly blended to form a homogeneous slurry. The crutcher mix moisture is 40%. This is passed to a drop tank, passed through a grinder, injected with air at a rate of 0.08% and pumped to a spray drying tower having 1 dual fluid nozzle arranged in a concurrent, straight air-flow configuration. The slurry is atomized by the compress air. The air inlet temperature is from 150-240° C., and the spraying pressure is about 200 kPa. The tower outlet temperature is about 70-90° C. The granules fall into a fluid bed dryer and get further dried. The final product has an average bulk density of about 450-500 g/L, and a low cake strength ~0.3 kg, good solubility and excellent flowability.

EXAMPLE 2

A slurry is made same as above Example 1 except that 15% sodium silicate 1.6r is used balanced by sodium sulfate. The product produced under same spray drying condition has a higher bulk density of about 500~600 g/L.

EXAMPLE 3

A slurry is made according to Example 1 except that 24% sodium silicate 1.6r is used balanced by sodium sulfate. The slurry is very difficult to dry in the spray drying tower. It tends to stick on the tower walls and the amount of granule generated is much less (only about 60%) than previous Examples 1-2 even the same amount of slurry goes through the tower. Very big lumps are also found at the bottom of tower.

EXAMPLE 4

A slurry is made according to Example 1 except that 8% sodium toluene sulphonate is used balanced by sodium sulfate. The slurry is difficult to dry in the spray drying tower. The product produced under same spray drying conditions has a low bulk density of about 400~450 g/L but a very high cake strength>8 kg.

EXAMPLE 5

A slurry is made according to Example 1 except that the crutcher mix moisture is 55%. The slurry is very thin and pumps through the system very easily. However, drying the slurry is more difficult and time consuming. The tower's hot air inlet temperature is raised to 200° C.-300° C., and the exhaust air temperature is 85° C.-100° C. Drying speed is much slower than in Example 1.

EXAMPLE 6

A slurry is made according to Example 1 except that 2% silicate 1.6r and the crutcher mix moisture is 24%. The slurry is very thick and very difficult to mix homogeneously. Eventually, it cannot be pumped through the pipeline into the drying tower.

EXAMPLE 7

Anionic surfactant, sodium sulfate, 2% sodium silicate 2.4r, 1% sodium co-polymer of acrylate and maleate (MW about 15,000), 1% sodium toluene sulphonate, other polymeric material, and optical brightener are mixed in a crutcher at about 60~70° C. until evenly blended to form a homogeneous slurry. The crutcher mix moisture is 33%. This slurry is passed to a drop tank, is passed through a strainer, and is pumped to a spray drying tower having 1 pressure nozzle arranged in a counter-current, straight air-flow configuration. Pressurized air is add into the slurry pressure line after the high pressure pump at pressure of about 9,000 kPa. The air flow rate is 0.02%~0.09% by weight of the slurry. The tower hot air inlet has a temperature of from 240-320° C., and the spraying pressure is about 4,000 kPa. The tower outlet temperature is about 70-90° C. The resulting granules have an average bulk density of about 450-550 g/L. The resulting granule has a high cake strength>5.0 kg, and poor flowability.

EXAMPLE 8

A slurry is made according to Example 7 except that 14% silicate 2.4r is used, balanced by sodium sulphate. Under the same spray drying condition, the granule produced have an average bulk density of about 380~450 g/L. The resulting granule has very low cake strength<1.5 kg, and good flowability.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for forming a low density detergent granule consisting of:

A. providing from about 0.1% to about 6% by weight, of a hydrotrope;

B. providing from about 22% to about 50% by weight, of crutcher mix moisture;

C. providing from about 0.2% to about 8% by weight, of a water-soluble polymer having a molecular weight of at least about 10,000 g/mol;

D. providing from about 2% to about 20% by weight, sodium silicate having a $SiO_2$:$Na_2O$ ratio of at least about 2:1;

E. providing the balance of adjunct crutcher ingredients;

F. mixing the hydrotrope, crutcher mix moisture, polymer, silicate and adjunct crutcher ingredients in a crutcher to form a slurry;

G. injecting a gas into the slurry at a pressure of from about 6,000 kPa to about 13,000 kPa, and at a rate of from about 0.01% to about 0.25% by weight;

H. forming the slurry into a detergent granule having a bulk density of from about 300 g/L to 500 g/L; and I. optionally, spraying an adjunct ingredient onto the detergent granule, wherein the slurry is free of zeolite builder and phosphate builder, and wherein the crutcher temperature is maintained at from about 40° C. to about 95° C.

2. The process according to claim 1, wherein the polymer is a copolymer of acrylic acid and maleic acid.

3. The process according to claim 1, wherein the sodium silicate has a $SiO_2$:$Na_2O$ ratio of from about 2:1 to about 5:1.

4. The process according to claim 1, wherein the forming step is spray drying.

5. The process according to claim 1, wherein the hydrotrope comprises a sulfonate moiety.

6. The process according to claim 1, wherein the gas comprises nitrogen gas.

7. The process according to claim 1 wherein the rate is from about 0.015% to about 0.15% by weight.

8. The process according to claim 1, wherein the crutcher mix moisture is from about 26% to about 38% by weight.

9. The process of claim 1, wherein the slurry comprises less than about 40% by weight, of an organic material.

10. The process of claim 4, wherein the step of spraying an adjunct ingredient onto the detergent granule is performed.

11. The process of claim 5, wherein the hydrotrope is selected from the group consisting of sodium, potassium, calcium and ammonium salts of toluene sulfonate, cumene sulfonate, xylene sulfonate, substituted or unsubstituted naphthalene sulphonate, and a mixture thereof.

12. The process according to claim 6, wherein the gas is air.

13. The process according to claim 10, wherein the adjunct ingredient is selected from the group consisting of a nonionic surfactant, a perfume, and a mixture thereof.

14. The process according to claim 10, wherein the adjunct ingredient sprayed onto the detergent granule comprises a nonionic surfactant, an amphoteric surfactant, an amine oxide, an anionic surfactant, a polymer, a perfume, and/or a silicate.

15. The process according to claim 14, wherein said anionic surfactant is selected from the group consisting of a $C_{11}$-$C_{18}$ alkyl benzene sulfonate, a primary, branched-chain and random $C_{10}$-$C_{20}$ alkyl sulfate, a $C_{10}$-$C_{18}$ secondary (2,3) alkyl sulfate, an unsaturated sulfate, a $C_{10}$-$C_{18}$ alkyl alkoxy sulfate, a sulfated polyglycoside, a $C_{12}$-$C_{18}$ alpha-sulfonated fatty acid ester, and a mixture thereof.

16. The process according to claim 15, wherein said anionic surfactant is at a level of at least 1% by weight of said detergent granule.

17. The process according to claim 10, wherein the step of spraying an adjunct ingredient onto the detergent granule is a step of spraying in a drum mixer or a fluid bed.

* * * * *

UNITED STATES PATENT AND TRADEMARK OFFICE

CERTIFICATE OF CORRECTION

PATENT NO. : 7,485,614 B2
APPLICATION NO. : 11/233327
DATED : February 3, 2009
INVENTOR(S) : Jeffrey Edward Boucher et al.

It is certified that error appears in the above-identified patent and that said Letters Patent is hereby corrected as shown below:

Column 7
Line 31, delete "Löbdige" and insert -- Lödige --.
Line 40, delete ""SCHUG™"" and insert -- "SCHUGI™" --.
Column 12
Line 9, delete "Comelissen," and insert -- Cornelissen, --.

Signed and Sealed this

Fifteenth Day of September, 2009

David J. Kappos

David J. Kappos
*Director of the United States Patent and Trademark Office*